US009038352B2

(12) United States Patent
Miedzik et al.

(10) Patent No.: US 9,038,352 B2
(45) Date of Patent: May 26, 2015

(54) HALF SHELL ELEMENT FOR THE PRODUCTION OF A HOLLOW BODY

(75) Inventors: Georg Miedzik, Hittnau (CH); Michael Stücklin, Zurich (CH)

(73) Assignee: Cobiax Technologies AG, Zug (CH)

( * ) Notice: Subject to any disclaimer, the term of this patent is extended or adjusted under 35 U.S.C. 154(b) by 328 days.

(21) Appl. No.: 13/515,691

(22) PCT Filed: Dec. 14, 2010

(86) PCT No.: PCT/CH2010/000311

§ 371 (c)(1),
(2), (4) Date: Aug. 24, 2012

(87) PCT Pub. No.: WO2011/075856

PCT Pub. Date: Jun. 30, 2011

(65) Prior Publication Data

US 2012/0311959 A1 Dec. 13, 2012

(30) Foreign Application Priority Data

Dec. 21, 2009 (EP) ..... 09015788

(51) Int. Cl.
*E04B 5/32* (2006.01)
*E04C 5/16* (2006.01)
*E04C 5/20* (2006.01)

(52) U.S. Cl.
CPC ..... *E04B 5/328* (2013.01); *Y10T 29/49826* (2015.01); *E04C 5/203* (2013.01)

(58) Field of Classification Search
CPC ..... E04C 1/34; E04C 5/07; E04B 5/328; E04B 9/0485; C04B 38/08
USPC ..... 52/677, 577, 576, 323, 380, 745.13; 249/176, 184
See application file for complete search history.

(56) References Cited

U.S. PATENT DOCUMENTS 3,043,354 A * 7/1962 Fitzgerald ..... 220/4.23
3,289,822 A * 12/1966 Schumer et al. ..... 206/8
5,396,747 A * 3/1995 Breuning ..... 52/516

(Continued)

FOREIGN PATENT DOCUMENTS

DE 1278087 * 9/1968 ..... E04C 1/00
DE 1935580 * 1/1971 ..... E04C 1/34

(Continued)

OTHER PUBLICATIONS

International Search Report from International Patent Application No. PCT/CH2010/000311 mailed Feb. 17, 2011.

(Continued)

*Primary Examiner* — Christine T Cajilig
(74) *Attorney, Agent, or Firm* — Alston & Bird LLP

(57) ABSTRACT

The invention concerns a half shell element (10) for the production of a hollow body with an identical further half shell element (10), with at least one guide (20 . . . 20''') for the further element (10), which is constructed in the region of a first half periphery (11) of its encircling edge (12), so that the further element (10) can be pushed onto the half shell element (10) from the second half periphery (11') of the edge (12) lying opposite this first half periphery (11) and guided on the edge (12) and held in a final position. The hollow bodies which are thus produced can be both inserted into steel cages and also connected with each other via bars and built into concrete layers.

18 Claims, 7 Drawing Sheets

(56) References Cited

U.S. PATENT DOCUMENTS

| | | | | |
|---|---|---|---|---|
| 5,797,230 | A * | 8/1998 | Lassen | 52/323 |
| 6,050,438 | A * | 4/2000 | Kovens et al. | 220/4.24 |
| D478,513 | S * | 8/2003 | Canamasas Puigbo | D9/529 |
| 6,789,366 | B1 * | 9/2004 | Febra | 52/576 |
| 7,275,642 | B2 * | 10/2007 | Yuhara | 206/581 |
| 7,540,121 | B2 * | 6/2009 | Haeussler | 52/323 |
| 8,322,112 | B2 * | 12/2012 | Luburic | 52/745.13 |
| 8,443,567 | B2 * | 5/2013 | Swenson et al. | 52/677 |
| 2004/0040960 | A1 * | 3/2004 | Gledhill | 220/23.4 |
| 2004/0050945 | A1 * | 3/2004 | Bernhardt | 237/69 |
| 2007/0199254 | A1 * | 8/2007 | Luburic | 52/80.1 |
| 2009/0165418 | A1 * | 7/2009 | Verelli et al. | 52/649.1 |
| 2009/0165420 | A1 * | 7/2009 | Pfeffer et al. | 52/677 |
| 2010/0132290 | A1 * | 6/2010 | Luburic | 52/309.16 |

FOREIGN PATENT DOCUMENTS

| | | | |
|---|---|---|---|
| WO | WO 92/06253 | A1 | 4/1992 |
| WO | WO 99/64696 | A1 | 12/1999 |
| WO | WO 02/092935 | A1 | 11/2002 |
| WO | WO 2005/080704 | A1 | 9/2005 |

OTHER PUBLICATIONS

International Preliminary Report on Patentability from International Patent Application No. PCT/CH2010/000311 dated May 9, 2012.

* cited by examiner

HALF SHELL ELEMENT FOR THE PRODUCTION OF A HOLLOW BODY

CROSS REFERENCE TO RELATED APPLICATIONS

This application is a national stage application filed under 35 U.S.C. 371 of International Application No. PCT/CH2010/000311, filed Dec. 14, 2010, which claims priority from European Application No. 09015788.4, filed Dec. 21, 2009, both of which are hereby incorporated herein in their entirety by reference.

The present invention concerns the technical field of structural engineering and in particular a half shell element for the production of a hollow body and a hollow body consisting of a combination of half shell elements connected with each other. The invention further relates to a tool for the production of a hollow body and a method for the production of a hollow body using the tool. In addition, the invention also concerns a method for the connecting of hollow bodies and a preferred use of this hollow body.

Hollow bodies of a plastic material are usually cast integrally in concrete layers in order to make them lighter and, at the same time, more favourably priced. For this, they are inserted into steel cages which, at the same time, make the concrete element which is to be manufactured more stable. Thus, for example, from the applicant's WO/2005/080704 hollow bodies which are closed in a spherical shape and also hollow half shell elements which are open toward the bottom, or closed, are known which are used for the manufacture of particularly efficient concrete surfaces. A disadvantage in the closed hollow bodies, however, is that their production requires a blow moulding process, which is laborious and expensive. In addition, this method requires thicker wall thicknesses of the products, whereby the hollow body not only becomes expensive, but also unnecessarily heavy. Downwardly open half shells can in fact be produced by the simpler and more favourably priced injection moulding process, but have the disadvantage that their displacement volume is reduced by inflowing concrete, and the necessary concrete volume can not be exactly determined and controlled.

It is an object of the present invention to make possible the simple, quick and reliable production of a hollow body, which is able to be handled easily and which, furthermore, is also able to be produced at a favourable price in large numbers.

This problem is solved by a half shell element according to some embodiments detailed herein.

An essential point of the half shell element according to the invention consists in that it is able to be handled particularly easily. This is because, for the production of a hollow body from this element, a different, complementary element is not necessary, but rather an exactly identical one again. Thereby, not only are mistakes ruled out, but also the possibility that an anomalous number of respectively complementary elements can be delivered to a building site. The latter can lead to a considerable loss of time and hence to additional costs particularly when the elements have to be transported by sea over long distances, such as for example from Europe to Asia. As the elements in their half shell embodiment are able to be stacked at the same time into each other or onto each other, a smaller transportation volume occurs, which again saves costs. At the same time, their transportation weight is reduced, because the elements are injection-moulded and hence can be embodied with smaller wall thicknesses, e.g. of between 1 mm and 1.5 mm. In addition, their production in large numbers becomes more favourably priced and quicker.

Preferred embodiments of the half shell element are indicated herein. These concern structural details which, however, have great implications.

Thus, in an advantageous embodiment of the half shell element provision is made that the at least one guide is constructed as a groove for embracing an edge region of the further half shell element. In fact, other types of guiding of the elements to each other, such as e.g. pin guides or similar, are basically also conceivable. The elements could also be fastened to each other by simple clips, plug connectors, rivets or screws. A guide constructed as a groove, however, ensures a guidance and fastening of the elements to each other which is both simple to produce and able to be handled easily and is at the same time reliable. In particular, for this the length wall thickness of the guide can be selected accordingly and the reciprocal clamping thereof can be influenced in order to ensure a secure holding of the elements in the final position.

This final position is preferably secured by a detent hook and a detent surface for engaging on a complementary detent surface and a complementary detent hook of the further half shell element being provided, which are arranged lying opposite each other respectively in approximately the middle of a first half periphery of the encircling edge. The further element therefore engages in its final position over the other element, and for example can also not slip out of its position, on fitting of the elements into steel cages or on laying of steel reinforcements, over the filled cages. This makes it able to be handled extraordinarily well both in manual work for smaller project units and also in an automated manner for large numbers and, moreover, makes it reliable in its application. A particularly easy positioning and engaging of the half shell elements to each other is ensured in that on both sides of the detent surface on the encircling edge, detent grooves are constructed for embracing an edge region of the further half shell element. These detent grooves are constructed in a tongue shape and have the aim that the further half shell element on mounting travels into these detent grooves and at the same time the detent hook engages into the detent surfaces and the further half shell element is therefore secured in its position. The detent hook has the function of preventing the opening of the half shell element in horizontal direction. The two detent grooves now have the aim that this detent hook can not move out from the detent position owing to external application of force, by the detent position now also being fixed vertically.

Basically, the half shell element can also have the shape of a hemisphere or of an ellipsoid, in order to make it available for its specific purpose of application. However, it can also have a flattened area on the pole side, which is conducive for this. In addition, this allows an element which is shaped in such a way to also be easily handled when an identical element is to be pushed on. For this, it can be deposited without, for example, rolling away. The same applies to a hollow body which has been composed from two of the elements.

The flattened area preferably has an encircling shoulder with an indented base surface surrounded thereby, which in combination distinctly increase the rigidity and hence the stability of the element. In addition, the base surface can be provided with information, stamped therein or thereon, concerning the half shell element. This information can comprise for example details concerning the manufacturer, the use, the production or references to protective rights etc. This also increases the manageability of the element. An additional manufacture conducive to this purpose, e.g. of labels which can be stuck on, is superfluous.

In the installation of a half shell element with downwardly turned half shell, as far as possible no air inclusion is to be able to form on its recessed base surface. In order to reliably prevent this, it is preferred that the encircling shoulder has at least one channel which extends as an extension of the base surface towards an outer surface of the half shell element. Thereby, the air can escape away from the base surface to an outer surface of the element. With an upwardly turned half shell, on the other hand, for example rain water or condensation water can be drained off from the indented base surface towards the outer surface of the half shell element. Thereby, on the one hand a defined displacement effect of the half shell element is achieved in a particularly simple and reliable manner. At the same time, however, the element is also able to be used irrespective of the weather conditions, because in particular the formation of layers of ice is prevented, which endanger its specific purpose.

On the other hand, in order to prevent reinforcing steel from coming to lie in these channels, the base surface is provided, in extension of the at least one channel, preferably with at least one respective elevation at the height of the shoulder. To drain off e.g. condensation water from an interior of the half shell element, the at least one elevation is preferably provided here with a through-bore, which connects an inner side with an outer side of the half shell element. On the other surface, on the other hand, preferably a V-shaped cross-piece is formed, which is open towards a detent hook and/or towards a detent surface, in order to hold off water running off externally on the element from the detent connection and hence a penetration into the half shell element.

To reinforce the half shell element, reinforcement ribs preferably run on its inner surface, which extend in a star shape originating from the pole of the element. These are preferably dimensioned and shaped so that they lie against the outer surface of a complementary half shell element which is stacked into the half shell element. Thereby, in particular a defined vertical stacking of the individual elements into each other or onto each other is ensured, which in turn increases their manageability and in addition reduces their transportation volume and hence the transportation costs.

To connect the half shell element described above with further identical elements, it preferably has an outer surface which is provided with at least a first clip for the clamping of a bar. The clips are aligned in a connecting direction of the half shell elements in which a number of elements are to come to lie one behind the other. Thereby, the steel cages which are usually necessary, which hold the half shell elements in a desired position are dispensed with. The half shell elements transfer the forces here which hitherto were led off via the support bars of a cage. At the same time, the number of half shell elements which are able to be connected with each other is only limited by the length of an available bar. The clipping in of the bars is able to be carried out most particularly simply and quickly, compared with the fitting of the half shell elements into a cage, and in addition also permits a variable arrangement of the elements along a bar, depending on requirements. Since also entire cages are no longer required, but rather only for example single steel strips, both the material and transportation costs are reduced in this respect. In addition, such strips can also be ordered on-site, so that their central provision is dispensed with and their local distribution is possible.

Preferably, the outer surface of a half shell element can be provided with at least one second clip, which is turned about an angle of greater than 0° to 90° with respect to the first clip. Thereby, it becomes possible to connect the elements with each other not only in a connecting direction predetermined by the first clips, but also a direction turned in particular through 90° or 45° thereto. By connecting the first clips of half shell elements lying above, for example a row of elements lying above can be formed, whilst by connecting the second clips of a complementary half shell element lying below, a row of elements lying below, parallel thereto, can be connected. Thereby, in a particularly simple and quick manner, entire surfaces of half shell elements (completed to form hollow bodies) can be constructed and laid efficiently in concrete layers.

A particularly resilient connection between the half shell elements can be produced if the first and the second clips have a different clamping height. This is because in this case an individual half shell element can be connected equally in two different connecting directions with further identical elements, without the bars used for this impeding each other reciprocally. These do not block each other reciprocally, because they intersect at different clamping heights and therefore permit a distinctly stronger integration of each element into a network of bars.

Basically, the clips can in fact be arranged at any suitable location on the outer surface of a half shell element. A particularly good handling results, however, when they are arranged in the region of a flattened area of the element on the pole side. Thereby, for example steel strips can firstly be deposited on the flattened areas of a deposited row of half shell elements and can then be simply pressed into the clips which are situated there, without the strip slipping down from the half shells.

If, on the other hand, the clips are arranged on a base surface of the flattened area, which is indented via a shoulder into the half shell element, the element can rest on its flattened area free of blocking on the reinforcement ribs of a further element, and is therefore able to be stacked in or on the latter.

The above problem is also solved by a hollow body according to some embodiments detailed herein. Such a hollow body is able to be produced in particular in a simple, reliable and quick manner and in large numbers at a favourable cost. Through its shape, which conveys away air and water, and through its high rigidity, it is, in addition, able to be handled reliably, is able to be used irrespective of the weather conditions and is robust.

In the simplest case, such a hollow body is constructed from two identical half shell elements which are connected with each other. Depending on a height of the respective half shells, therefore hollow bodies are able to be produced which are of differing size, but constructed point-symmetrically along their peripheral edges. Two half shell elements with a respective height of 0.07 m are suited for example for a layer thickness of around 0.25 m and elements with a respective height of 0.09 m for a layer thickness of around 0.30 m.

A particularly fine adjustment to the most varied of layer thicknesses is achieved in that the half shell elements which are connected with each other differ in their height. As the circumference of both elements remains unaffected by their respective height, their respective connectability is ensured. Thus, hollow bodies of almost the most varied form can be produced. For example, ellipsoid, hemispherical, lentoid or other half shell elements can be completed to form a respective hollow body in the most varied combination. A combination of half shell elements with a respective height of 0.07 m and 0.09 m is suited for example for layer thicknesses of around 0.275 m. At the same time, only a small number of injection moulds is necessary for this. Thus, for example, with only 3 different moulds a total of 6 different hollow bodies, with 4 different moulds a total of 10 different hollow bodies, etc. can be provided. The technical effort and hence also the production costs are thereby reduced with respect to the achieved variance in the end product.

The above problem is solved in addition by a tool for the production of hollow bodies, which distinctly increases the assembly speed thereof from two of the described half shell elements. The reason for this in particular is that a half shell element can be held in a defined position and is therefore prevented from slipping away. For the further processing of the hollow body, the latter can be inserted directly into a steel cage for example in a next working step, or can be connected with further hollow bodies in another manner, before the next half shell element is inserted into the mounting of the tool.

The above problem is also solved by a method for the connecting of hollow bodies, by which individual rows or entire surfaces of hollow bodies can be produced simply and quickly. The length, shape, packing density etc. of these rows or surfaces are able to be selected as desired, compared with rigid steel cages, and are only limited by the length of the bars. The handling of the hollow bodies is therefore also distinctly improved by this connecting technique and remains guaranteed always, particularly also under difficult technical requirements.

Finally, the hollow body is preferably to be used as a displacer in a concrete layer, such as for example in the manufacture of concrete slabs, walls or ceilings on a building site by the in-situ concrete method or else in a prefabricated concrete works.

The invention is described in detail below with the aid of an example embodiment with reference to the attached drawings. Identical or identically acting parts are given the same reference numbers. In the drawings.

Figure 1A:
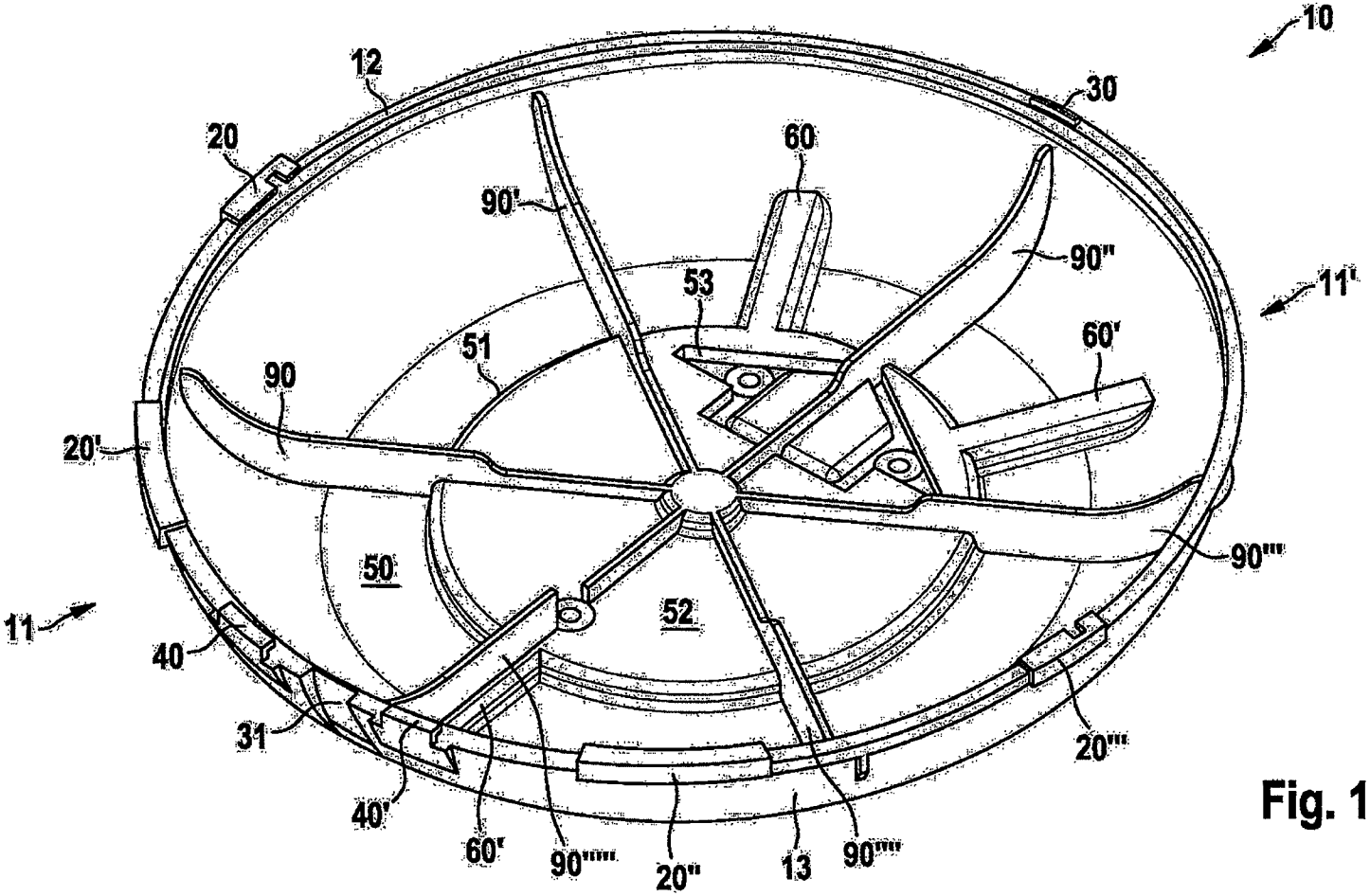
FIG. 1A shows a top view from obliquely above onto a half shell element according to the invention.

FIG. 1A shows a top view from obliquely above onto a half shell element 10 according to the invention. Guides 20, 20', 20', 20''' constructed approximately in a U-shape in cross-section are arranged on a first half periphery 11 of its edge 12. To produce a hollow body, an identical further half shell element 10 with identically constructed guides 20, 20', 20'', 20''' can now be pushed on over the second half periphery 11' onto the half shell element 10, wherein the guides 20, 20', 20'', 20''' on both sides embrace respective edge regions of the elements 10, i.e. the respective edge region is guided into a respectively opposite groove and is held there. The guides 20, 20', 20'', 20''' can be designed longer or shorter here, depending on the purpose of use of the half shell element 10 and the loads which are to be expected here. For this, the reciprocal clamping of the guides 20, 20', 20'', 20''' can also be designed to be stronger or weaker.

In a final position, the pushed-on half shell element 10 comes to lie precisely over the half shell element 10 and engages on the one hand on the detent hook 30 and on the other hand on the detent surface 31, respectively via its complementary detent surface and via its complementary detent hook. In order to assist this engagement, detent grooves 40, 40' are provided on both sides of the detent surface 31 on the encircling edge 11, which embrace the edge region of the further half shell element 10 and permit a precise positioning of the two elements 10 with respect to each other. In this way, a quick, simple and reliable connection of both elements 10 is possible, which is also safe to step on under construction conditions, i.e. also does not open under load. Here, both confusion and also the delivery of an irregular number of elements 10 are reliably ruled out, because the complementary elements 10 are designed identically. The half shell form of the elements 10 permits their favourably priced production by injection moulding, which requires smaller wall thicknesses and hence lower material costs.

Figure 1B:
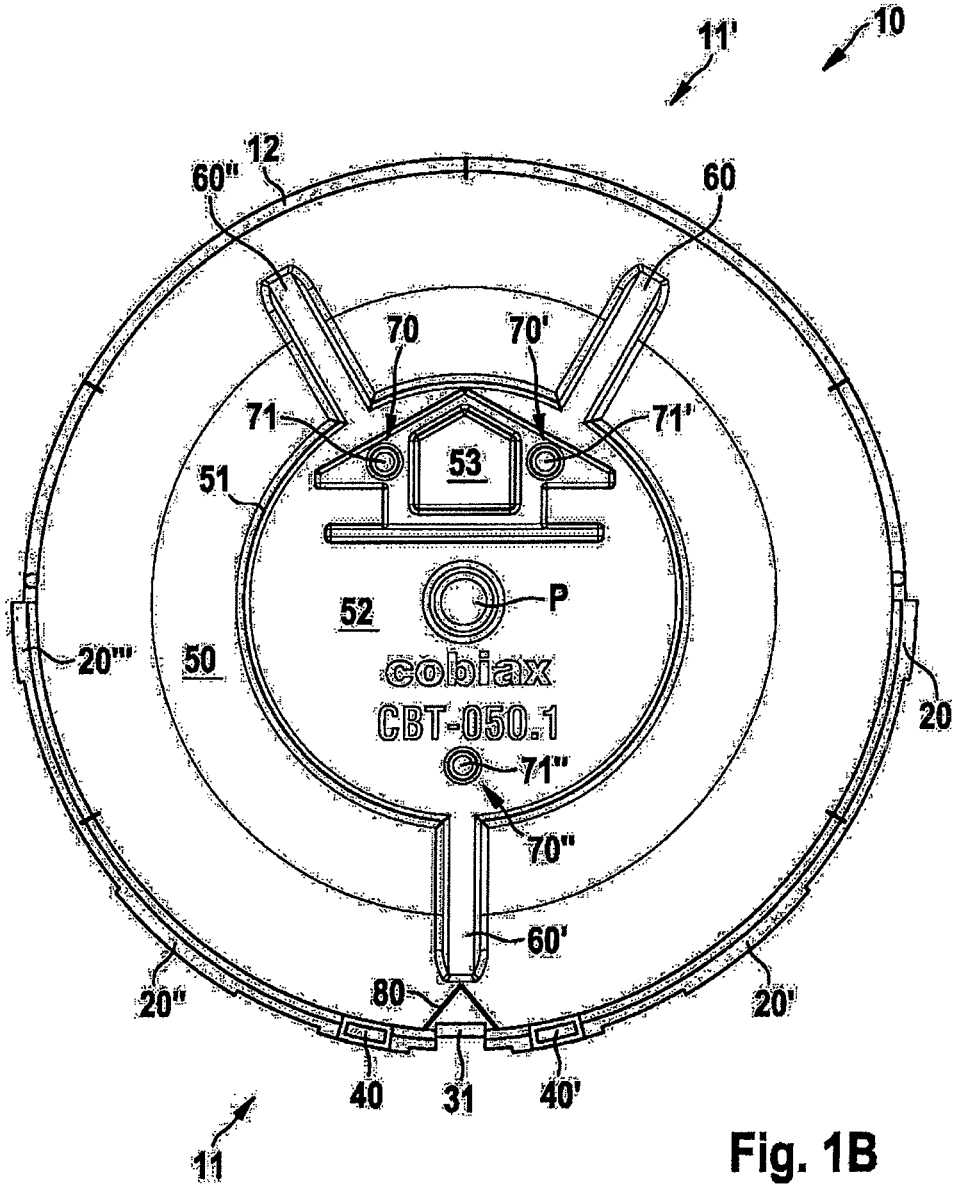
FIG. 1B shows a top view onto the underside of the half shell element of FIG. 1A.
Figure 1C:
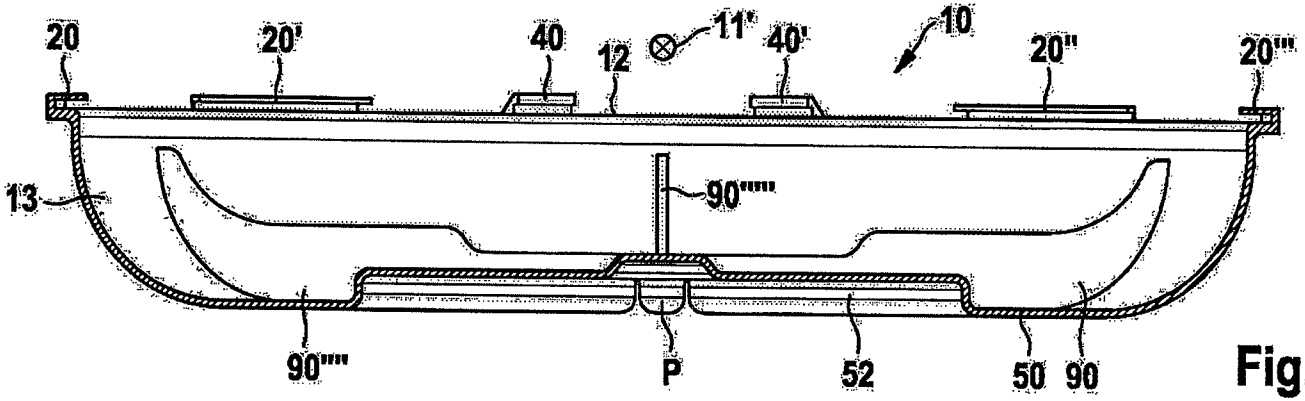
FIG. 1C shows a lateral view of the half shell element in the vertical half section of FIG. 1B.
Figure 1D:
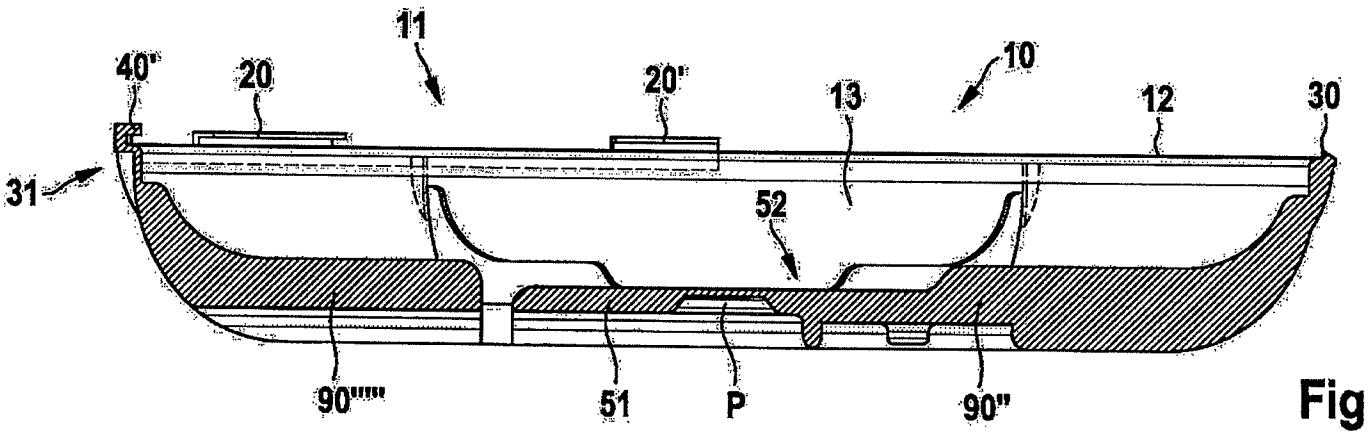
FIG. 1D shows a lateral view of the half shell element in the horizontal half section of FIG. 1B.

To increase the rigidity of the half shell element 10, the latter is provided with struts 90 . . . 90''''', which originate in a star shape from its pole P (designated in FIGS. 1B to 1D). These are designed at the same time so that they lie against the outer surface of each further element 10 and make these stackable in a space-saving manner. A flattened area 50, on the pole side, of the element 10 permits a secure placement here. At the same time it can not, for example, roll away when an identical further element 10 is to be pushed on. The flattened area 50 can be formed stronger or weaker here, depending of the purpose of use of the element 10 in thin or thick concrete layers. The rigidity of the half shell element 10 is increased in addition by its shoulder 51, which surrounds an indented base surface 52. This base surface 52 serves here for the arrangement of additional information 53, such as details concerning the manufacturer and the use of the element 10. By the stamped arrow, the information 53 also indicates a mounting direction in which this element 10 is to be pushed onto another. In order to avoid inclusions of air on the indented base surface 52 of an element 10 with downwardly turned half shell, channels 60, 60', 60'' are provided, which penetrate the shoulder 51 as an extension of the base surface 52. These serve at the same time for the draining off of rain water on an element 10 with upwardly turned half shell. The element 10 can therefore also be used in the rain without accumulations of water forming on its upper side.

FIG. 1B shows a top view onto the underside of the half shell element 10 of FIG. 1A. In addition to the technical details of the element 10 already described in FIG. 1A, round elevations 70, 70', 70'' can be see here, which are arranged in extension of the channels 60, 60', 60'', and their height corresponds approximately to that of the shoulder 51. Thereby, it is prevented in particular that reinforcement steel, laid over the element 10, engages into the channels 60, 60', 60'' and blocks these. The elevations 70, 70', 70'' are provided on the other hand with central through-bores 71, 71', 71'', which connect an inner side with an outer side of the element 10. Thereby, rain water or condensation water can emerge from the interior of the element 10, which could collect there e.g. during transportation or during storage on the building site. External water is directed from the base surface 52 via the channels 60, 60', 60'' to the outer surface 13 of the element 10, where it runs off along the outer arm of a V-shaped cross-piece 80. This cross-piece 80 opens out towards a respective detent surface 31, so that the water is prevented from penetrating into the detent connection 30, 31. At the same time, the arrow-shaped form of the cross-piece 80 also indicates the direction in which the element 10 is to be mounted, in order to obtain a desired hollow body. The information 53 on the base surface 52 of the half shell element 10 designate here the manufacturer cobiax and the half shell type CBT-050.1.

FIG. 1C shows a lateral view of the half shell element in vertical half section of FIG. 1B. Therein, in particular the shape of the guides 20, 20', 20'', 20''' can be seen, the cross-section of which is configured substantially in a U-shape. If a further element 10 is pushed on, edge regions of this further element 10 are embraced by the grooves of the guides 20, 20', 20", 20'" of the element 10 which is to be completed, and vice versa. For engagement of the detent hooks 30 on the detent surfaces 31 (both not shown), the detent grooves 40, 40' must embrace the edge region of the further half shell element, which can be readily seen from the exterior and facilitates positioning.

FIG. 1D shows a lateral view of the half shell element in the horizontal half section of FIG. 1B. On the one hand, the detent hook 30 and the opposite detent surface 31 with a detent groove 40' can be seen, and on the other hand also the guides 20, 20' on the first half periphery of the edge 12. The reinforcement ribs 90" and 90"" are designed here so that the flattened area 50 of a further half shell element 10 would rest on all ribs 90" and 90"" and makes possible a secure stackability of the elements 10. The mounting of two half shell elements 10 to a hollow body is preferably carried out by means of a tool which is equipped with a mount for an element 10, which is constructed in a complementary manner to a shape and/or to a structure of the outer surface 13 of the element 10. Thereby, a slipping or twisting of the element 10 on pushing on of a further element 10 is prevented. In particular on engaging of the detent hook 30 on the detent surface 31 in a final position of the further element 10, a resistance is to be overcome here, which can be taken up by the tool. The reliable engagement of the connection is then indicated by a distinctly discernible clicking sound. The resultant hollow body can then be removed from the tool and processed further, with it preferably being inserted into a steel cage or being connected via bars (shown in FIGS. 2 to 4) with further hollow bodies.

Figure 2:
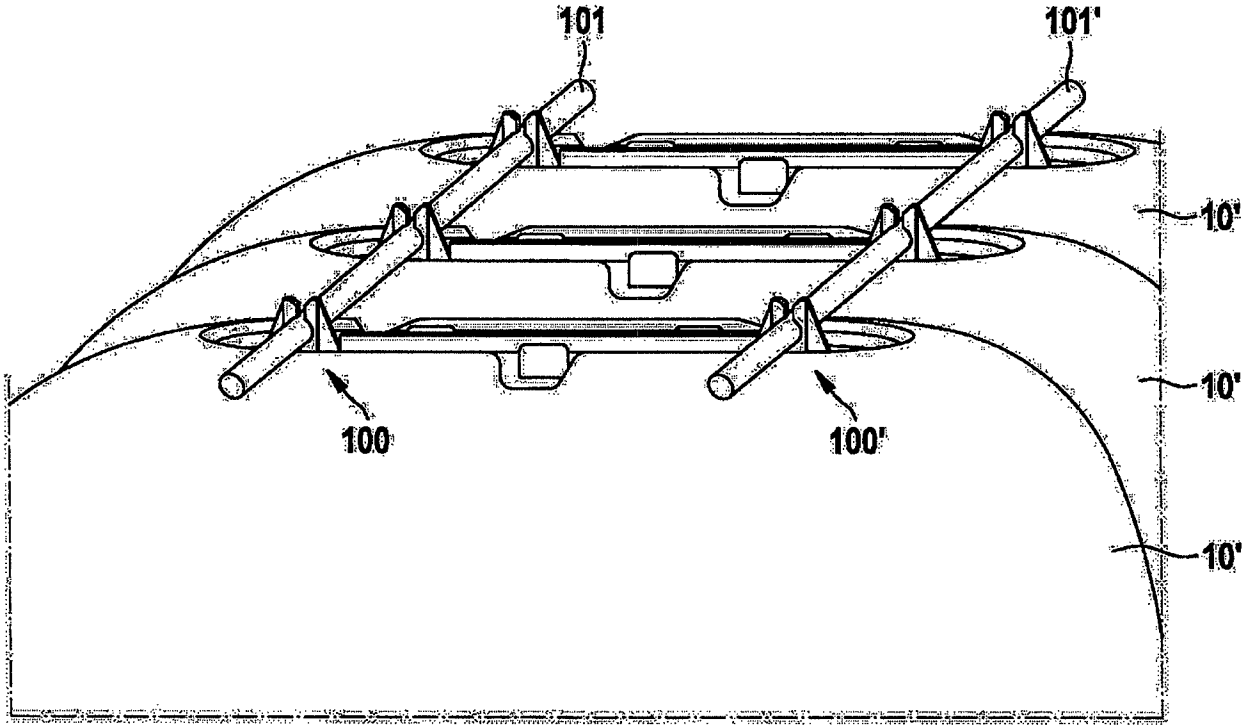
FIG. 2 shows a top view from obliquely above onto half shell elements according to the invention with clips.

FIG. 2 shows a top view from obliquely above onto half shell elements 10' according to the invention with clips 100, 100'. The elements 10' are coupled with each other via bars 101, 101', which are held in the respective clips 100, 100'. In this example, the clips 100, 100' are arranged on both sides of the indented base surface 52 in a desired connecting direction of each element 10'. Its flattened area 50 thereby remains free and each element 10' is able to be stacked, free of blockage, on the reinforcement ribs 90 . . . 90"" of a further element 10'.

In addition to the arrangement of first clips 100, 100', provision can also be made to provide additional second clips (not illustrated), which are aligned in a first direction turned greater than 0° to 90° with respect to the first clips 100, 100'. These can also be preferably arranged on the base surface 52. Thereby, several rows of elements 10', connected with each other, can be arranged in a simple manner, therefore can form a surface of half shell elements 10' (completed to form hollow bodies). The second clips are preferably turned here at an angle of 45° or 90° with respect to the first clips 100, 100', so that the half shell elements 10' are formed, lying either directly adjacent to each other (with clips at 90°) or staggered with respect to each other (with clips at 45°). In particular in the case of half shell elements 10' lying staggered with respect to each other, thereby a densely packed surface of half shell elements 10' (completed to form hollow bodies) can be constructed.

Figure 3:
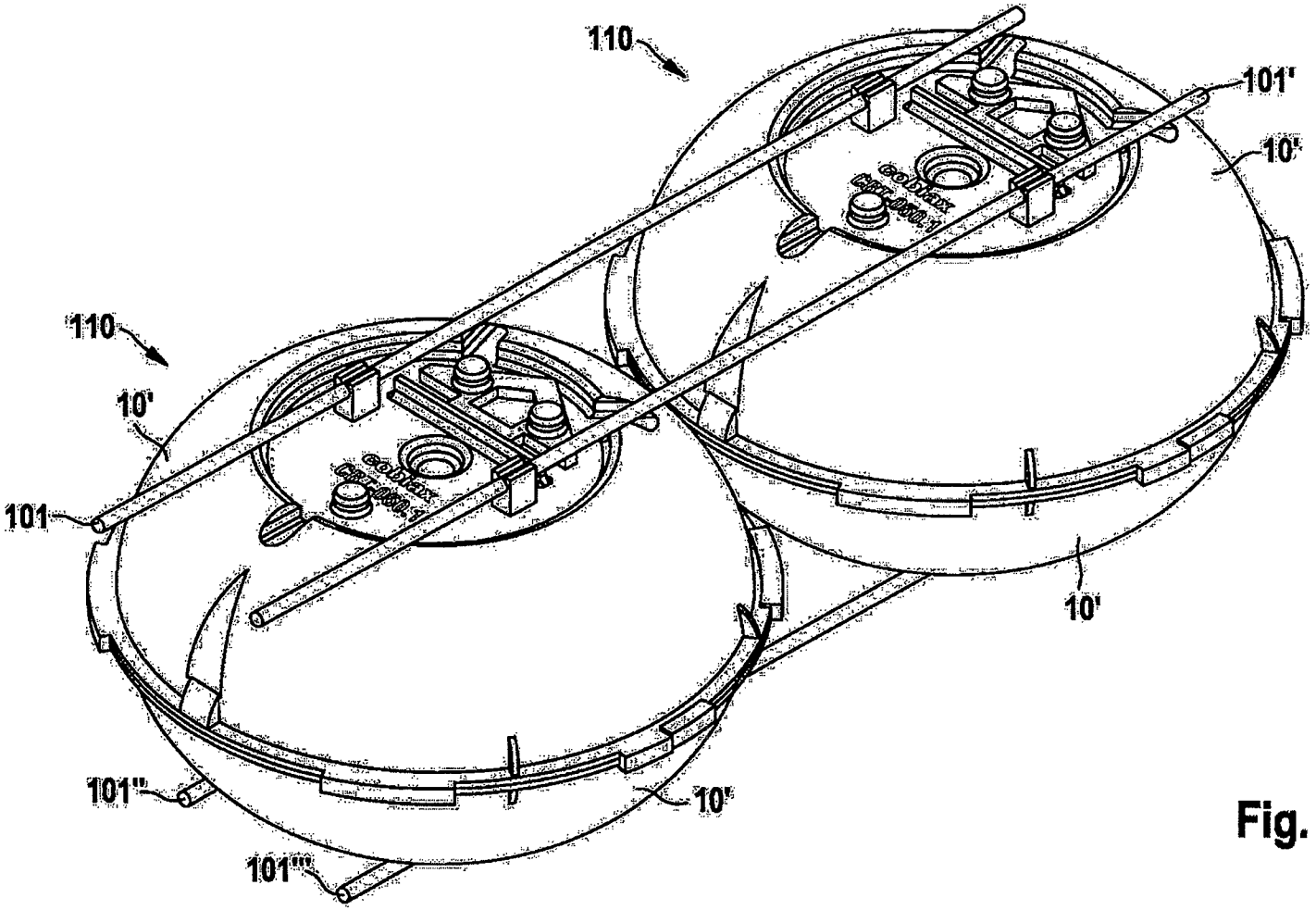
FIG. 3 shows a top view from obliquely above onto the completed half shell elements of FIG. 2.

FIG. 3 shows a top view from obliquely above onto the completed half shell elements 10' of FIG. 2. These form individual hollow bodies 110, which are connected with each other both on their upper side and on their underside via bars 101 . . . 101'". The distance between the hollow bodies 110 can vary depending on requirements, so that denser or wider connection distances between the bodies 110 are able to be realized according to requirements. If a surface of hollow bodies 110 were to be constructed here, the upper bars 101, 101' or the lower bars 101", 101'" can also be held on additional, correspondingly turned clips of the elements 10', so that the bars run angled to each other on the upper or respectively lower side of the hollow bodies 110. Such a network could be further reinforced by the first clips 100, 100' and the second clips having different clamping heights, so that both on the upper side and also on the underside of the hollow bodies 110, bars would be able to be arranged running respectively angled to each other which, owing to their different clamping height, do not block each other reciprocally. In each case, through the identical half shell elements 10', provided with clips 100, 100', in a particularly simple and quick manner a row or a surface of hollow bodies 110 can be constructed, which can be differently spaced and differently reinforced depending on direction. In this respect, the clips 100, 100' permit a particularly flexible use of the half shell elements 10'.

Figure 4:
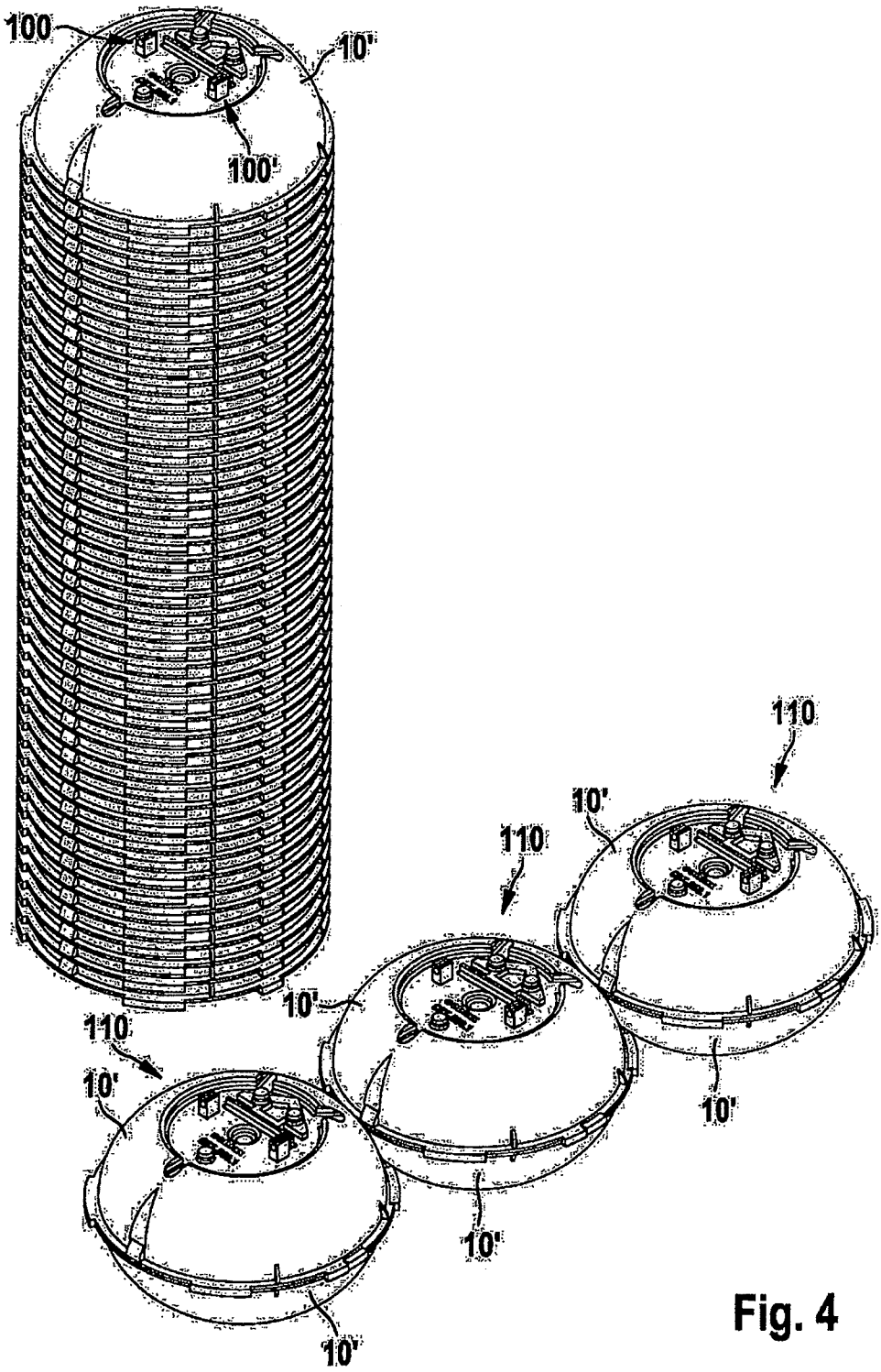
FIG. 4 shows a stack of half shell elements and two hollow bodies produced therefrom.

FIG. 4 shows a stack of half shell elements 10' and two hollow bodies 110 produced therefrom, which are all equipped with clips 100, 100'. The stack of half shell elements 10' takes up a comparatively small space here, whereby its transportation costs are distinctly lower compared with those of prefabricated hollow bodies. Nevertheless, the half shell element according to the invention permits a simple, quick and reliable production of a hollow body 110, which easy to handle and which, moreover, is also able to be produced in large numbers at a favourable cost.

Figure 5:
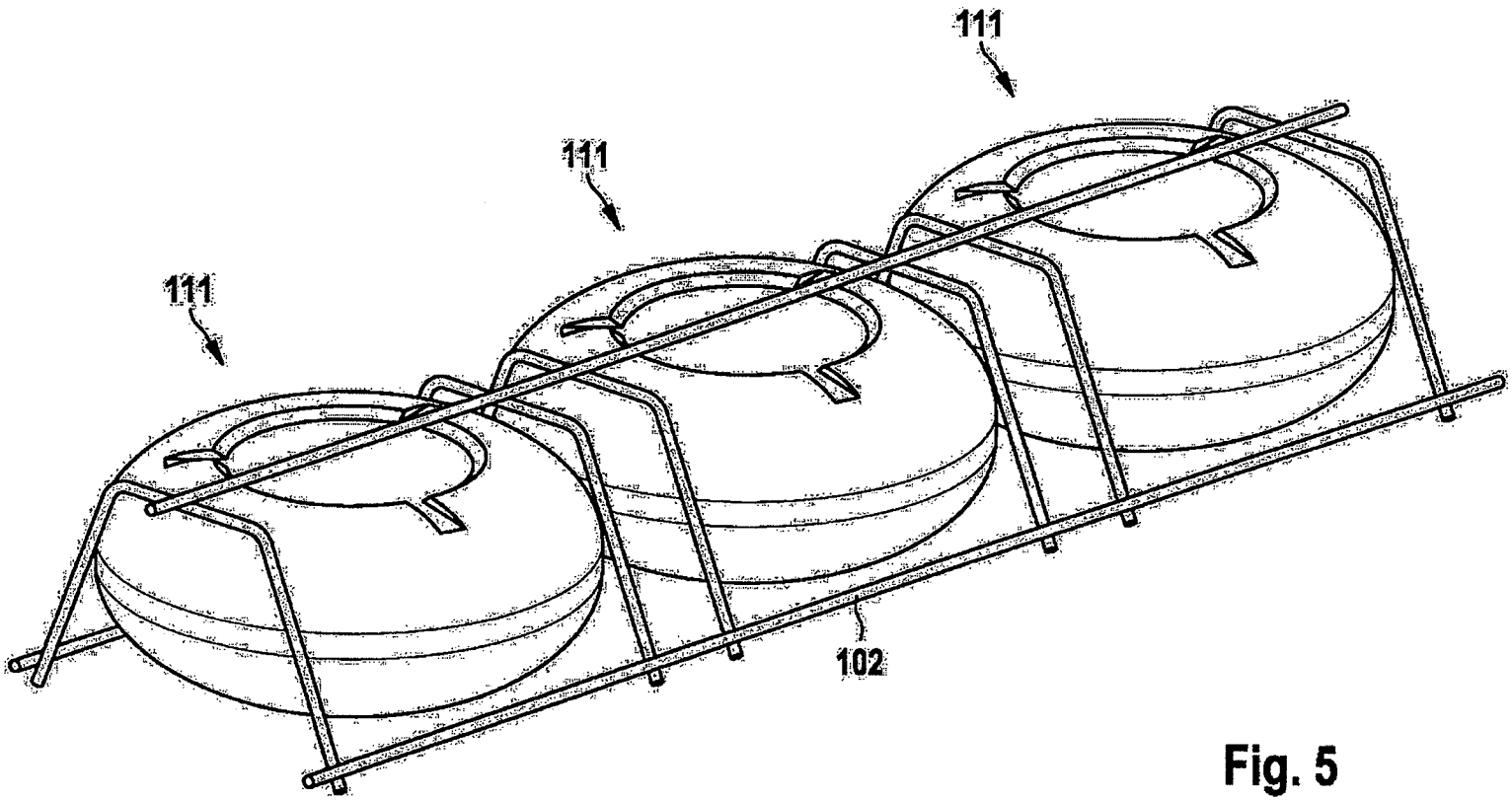
FIG. 5 shows a perspective view of a conventional connection of known hollow bodies.

FIG. 5 shows a perspective view of a conventional connection of known single-piece hollow bodies 111 by means of a steel cage 102, as it is used today. Both the production and also the transportation of such parts is expensive and laborious, they are difficult to handle and tight limits are set on their applicability.

The invention claimed is:

1. Half shell element (10, 10') for the production of a hollow body (110) with an identical further half shell element (10, 10'), with at least one guide (20 . . . 20'") for the further element (10, 10'), which is constructed in a region of a first half periphery (11) of its encircling edge (12), so that the further element (10, 10') is configured to be pushed onto the half shell element (10, 10') edgewise from the second half periphery (11') of the edge (12) lying opposite this first half periphery (11) parallel to a plane of the encircling edge (12) and can be guided on the edge (12) and held in a final position, and a detent hook (30) and a detent surface (31) for engagement on a complementary detent surface (31) and a complementary detent hook (30) of the further element (10, 10'), which are arranged lying opposite each other respectively in approximately the middle of the first and second half periphery (11, 11') of the encircling edge (12), wherein detent grooves (40, 40') for embracing an edge region of the further half shell element (10, 10') are constructed on both sides of the detent surface (31) on the encircling edge (12).

2. Half shell element (10, 10') according to claim 1, in which the at least one guide (20 . . . 20'") is constructed as a groove for embracing an edge region of the further half shell element (10, 10').

3. Half shell element (10, 10') according to claim 1, in which the half shell element (10, 10') has a flattened area (50) on a pole side.

4. Half shell element (10, 10') according to claim 3, in which the flattened area (50) has an encircling shoulder (51) with an indented base surface (52) surrounded thereby.

5. Half shell element (10, 10') according to claim 4, in which the base surface (52) is provided with information (53) stamped therein or thereon concerning the half shell element (10, 10').

6. Half shell element (10, 10') according to claim 4, in which the encircling shoulder (51) has at least one channel (60 . . . 60") which extends as an extension of the base surface (52) towards an outer surface (13) of the half shell element (10, 10').

7. Half shell element (10, 10') according to claim 6, in which the base surface (52) in extension of the at least one channel (60 . . . 60") is provided with at least one respective elevation (70 . . . 70") at the height of the shoulder (51).

8. Half shell element (10, 10') according to claim 7, in which the at least one elevation (70 . . . 70") is provided with a through-bore (71 . . . 71"), which connects an inner side with an outer side of the half shell element (10, 10').

9. Half shell element (10, 10') according to claim 1, on the inner surface of which reinforcement ribs (90 . . . 90""") run, which extend in a star shape originating from a pole (P) of the half shell element (10, 10').

10. Half shell element (10, 10') according to claim 9, in which the reinforcement ribs (90 . . . 90""") are dimensioned and shaped so that they lie against the outer surface (13) of a further half shell element (10, 10') which is stacked into the half shell element (10, 10').

11. Half shell element (10, 10') according to claim 1, in which an outer surface (13) of the half shell element (10, 10') has at least one first clip (100, 100') for the clamping of a bar (101 . . . 101'"), in order to connect this half shell element (10, 10') with further identical half shell elements (10, 10').

12. Half shell element (10, 10') according to claim 11, in which the at least one first clip (100, 100') is arranged in a region of a flattened area (50), on a pole side, of the half shell element (10, 10').

13. Half shell element (10, 10') according to claim 12, in which the at least one first clip (100, 100') is arranged on a base surface (52) which is indented into the half shell element (10, 10') via a shoulder (51) on the flattened area (50).

14. Hollow body (110), consisting of a combination of half shell elements (10, 10') connected with each other, according to claim 1.

15. Hollow body (110) according to claim 14, in which the half shell elements (10, 10') which are connected with each other are identical.

16. Hollow body (110) according to claim 14, in which the half shell elements (10, 10') which are connected with each other are different in their height.

17. Method for the connecting of hollow bodies (110), wherein the hollow bodies (110) are produced from a combination of half shell elements (10, 10') according to claim 11, in which a row or a surface of hollow bodies (110), connected with each other, is produced, by bars (101 . . . 101'"), running continuously over the hollow bodies (10, 10') which are to be connected, being clamped into the first clips (100, 100') of a hollow body (110) and into the corresponding first clips (100, 100') of all further hollow bodies (110), which lie in a respective running direction of a bar (101 . . . 101'").

18. Use of a hollow body according to claim 14 as displacer in a concrete layer.

* * * * *